US012091875B2

(12) United States Patent
Soto

(10) Patent No.: US 12,091,875 B2
(45) **Date of Patent: *Sep. 17, 2024**

(54) SYSTEM AND METHOD FOR STRETCHING AND SECURING FENCING

(71) Applicant: Pete Soto, Stephenville, TX (US)

(72) Inventor: Pete Soto, Stephenville, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/302,136

(22) Filed: Apr. 18, 2023

(65) Prior Publication Data

US 2023/0250670 A1 Aug. 10, 2023

Related U.S. Application Data

(63) Continuation of application No. 17/096,336, filed on Nov. 12, 2020, now Pat. No. 11,629,522.

(51) Int. Cl.
*E04H 17/02* (2006.01)
*E04H 17/26* (2006.01)

(52) U.S. Cl.
CPC ..... *E04H 17/127* (2021.01); *E04H 17/266* (2013.01)

(58) Field of Classification Search
CPC ..... E04H 17/02; E04H 17/04; E04H 17/05; E04H 17/06; E04H 17/10; E04H 17/12; E04H 17/124; E04H 17/127; E04H 17/14; E04H 17/26; E04H 17/261; E04H 17/266
See application file for complete search history.

(56) References Cited

U.S. PATENT DOCUMENTS

| | | | |
|---|---|---|---|
| 800,877 | A | 10/1905 | Pevoto |
| 965,692 | A | 7/1910 | Culp |
| 967,691 | A | 8/1910 | Walther |
| 969,951 | A | 9/1910 | Hanah |
| 977,958 | A | 12/1910 | Love |
| 1,023,749 | A | 4/1912 | Montgomery |
| 1,099,318 | A | 6/1914 | Snedeker |
| 1,107,406 | A | 8/1914 | Burns |

(Continued)

FOREIGN PATENT DOCUMENTS

| | | | |
|---|---|---|---|
| GB | 476119 | A | 12/1937 |
| GB | 2480913 | A | 12/2011 |

(Continued)

OTHER PUBLICATIONS

Office Action dated Aug. 4, 2022 from U.S. Appl. No. 17/096,336.

(Continued)

*Primary Examiner* — Jonathan P Masinick
(74) *Attorney, Agent, or Firm* — James E. Walton

(57) ABSTRACT

A system and method for stretching and securing fencing includes a clamping member having a clamping channel, a clamping bar configured to be received within the clamping channel, and at least one fastener for securing the clamping bar to the clamping channel; a stretcher bar having a plurality of hook members for engaging the fencing, and at least one notched opening configured to receive a tensioning device; wherein the clamping bar and the clamping channel are correspondingly shaped, sized, and configured, such that the fencing is held secure between the clamping bar and the clamping channel when the clamping bar is secured to the clamping channel.

20 Claims, 8 Drawing Sheets

(56) References Cited

U.S. PATENT DOCUMENTS

| | | | | |
|---|---|---|---|---|
| 1,122,829 | A | 12/1914 | Wernimont | |
| 1,182,924 | A | 5/1916 | Miller | |
| 1,214,136 | A | 1/1917 | Clark | |
| 3,211,426 | A | 10/1965 | Handley | |
| 3,881,690 | A | 5/1975 | Combs, Jr. | |
| 4,111,399 | A * | 9/1978 | Hutchison, III | B21F 27/005 245/8 |
| 4,380,327 | A | 4/1983 | Fish | |
| 5,409,196 | A | 4/1995 | Specht | |
| 2022/0096906 | A1* | 3/2022 | Lowrey | E04H 17/266 |

FOREIGN PATENT DOCUMENTS

| | | | |
|---|---|---|---|
| KR | 200341380 | Y1 | 2/2004 |
| KR | 20090131570 | A | 12/2009 |
| WO | 2005099928 | A1 | 10/2005 |
| WO | 2020176936 | A1 | 9/2020 |

OTHER PUBLICATIONS

Amendment dated Dec. 5, 2022 from U.S. Appl. No. 17/096,336.
Notice of Allowance dated Mar. 9, 2023 from U.S. Appl. No. 17/096,336.

* cited by examiner

SYSTEM AND METHOD FOR STRETCHING AND SECURING FENCING

This application is a continuation of U.S. patent application Ser. No. 17/096,336, filed 12 Nov. 2020, titled "System and Method for Stretching and Securing Fencing," which is incorporated herein for all purposes.

BACKGROUND

1. Field of the Invention

The present application relates to fences and methods of stretching and securing fencing. In particular, the present application relates to multiple strand, interconnected, and/or mesh fencing and systems and methods for stretching, erecting, repairing, securing, and maintaining such fencing.

2. Description of Related Art

Welded wire and net fencing has been around for many decades. This type of fencing is manufactured by welding or intertwining wire stock to form a mesh of small openings. The openings are either the same size or different sizes over the height of the fencing. The mesh prevents small animals, live stock, and varmints from getting through the fencing. Welded wire as well as net fencing is typically sold in large, heavy, galvanized rolls. The rolls are unwound, stretched along the fence line from one end post to another, and then tied to line posts and/or T-posts to hold the fencing upright and in place.

If the fencing is not stretched properly it will sag, twist, curl, and loosen. Once it becomes loose, the animals and livestock will often push against the loosened sections, resulting in the animals and livestock being able to escape under and/or over the damaged fencing. This fencing can also become damaged by other means, including trees and branches falling on the fencing, undergrowth and brush growing through the fencing, and tractors or mowers damaging the fencing.

There are many different ways to stretch welded wire or net fencing. The fencing is usually attached to one end post, rolled out along the fence line, loosely attached to some or all of the line posts or T-posts, and then stretched to a final position. Because these rolls are usually quite heavy, it is necessary to use a truck, tractor, all terrain vehicle (ATV), or a come-along winch system to properly stretch the fencing. The stretching step usually involves attaching hooks or stretcher bars with hooks to the one end of the roll and then pulling on the hooks or stretcher bar with the truck, tractor, all terrain vehicle (ATV), or come-along. Once the fencing is stretched to the desired length, the ties holding the fencing to the line posts and T-posts are tightened, and the fencing is cut to the desired length. Then, the end of the fencing is wrapped around the end post and secured with ties, wire, or clips. Because the fencing cannot be twisted upon itself, as with barbed wire and other single-wire fencing, the fencing does not stay tightly stretched over time. There are other problems with cutting and attaching the fencing to the end posts by wrapping the fencing around the end posts. Other than being unsightly, the sharp ends of the wire stick out and can snag on users as they pass by or can cut and scrape the animals and livestock, resulting in injury to users and animals.

Although great strides in the area of stretching and installing welded wire and net fencing, many shortcomings remain.

BRIEF DESCRIPTION OF THE DRAWINGS

The novel features believed characteristic of the present application are set forth in the appended claims. However, the present application itself, as well as a preferred mode of use, and further objectives and advantages thereof, will best be understood by reference to the following detailed description when read in conjunction with the accompanying drawings, wherein:

Figure 1:
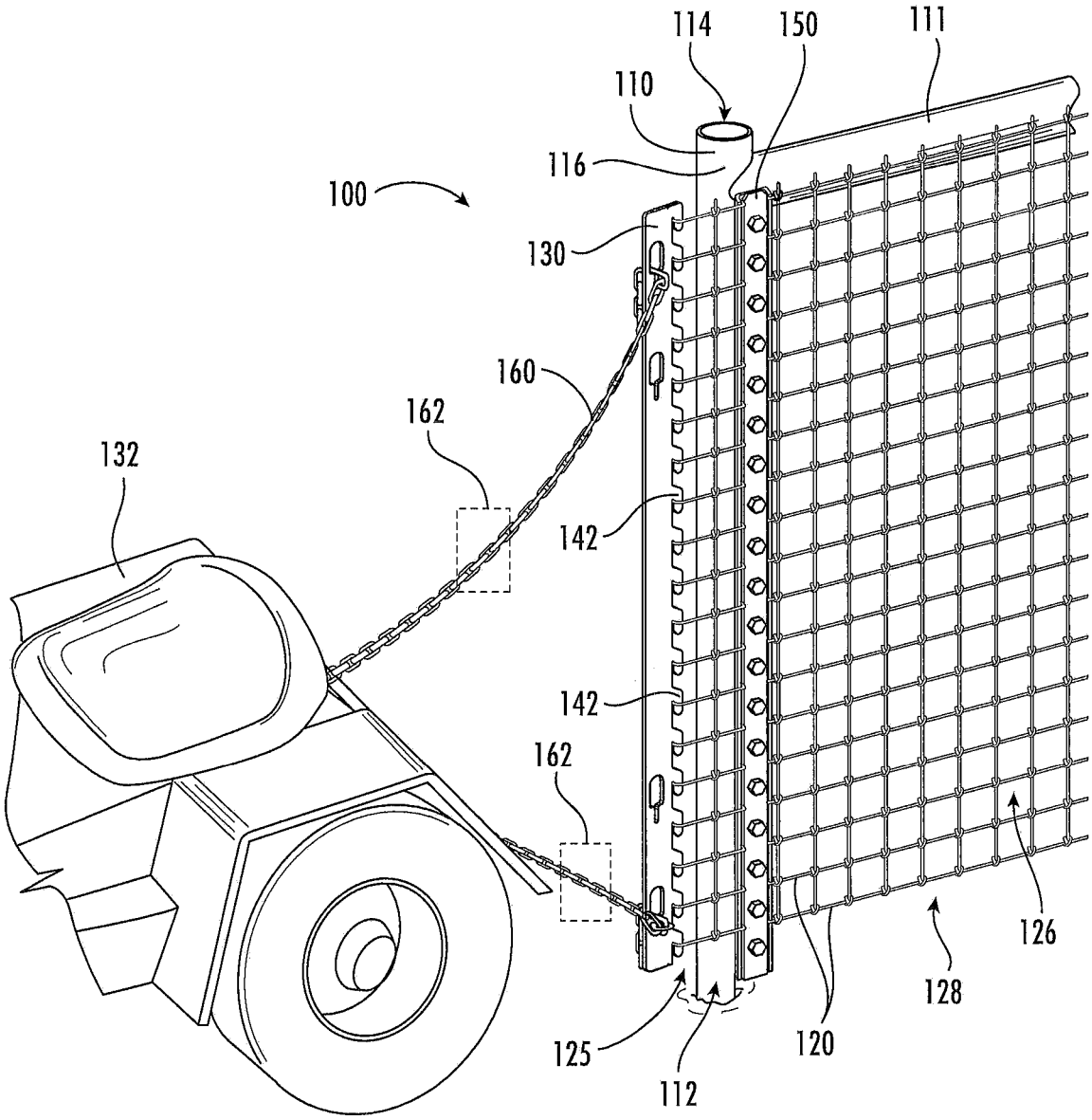
FIG. 1 is a perspective view of a system and method for stretching fencing according to a preferred embodiment of the present application.

While the assembly of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of a system and method for stretching and securing fencing according to the present application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring now to FIG. 1 in the drawings, a system 100 for stretching welded wire and/or net fencing 120 is illustrated.

System 100 includes a stretcher bar 130 and a clamping member 150. Stretcher bar 130 preferably extends over the entire height of fencing 120; however, it will be appreciated, that stretcher bar 130 may be longer or shorter than the height of fencing 120. Clamping member 150 is preferably attached to an end post 110 having a bottom portion 112 and a top portion 114. It is preferred that clamping member 150 be permanently attached to end post 110, such as by welding. Stitch welding is particularly well suited for attaching clamping member 150 to end post 110. Although end post 110 is preferably a metal post, it will be appreciated that end post 110 may be any structure capable of receiving clamping member 150, including wooden poles, trees, or other structures, such as fences, buildings, or barns.

End post 110 is preferably connected to one or more cross supports 111, such as in an H-post configuration. Although cross support 111 is depicted as a lateral support, cross support 111 can also be configured as an angled support, such as a "kicker" support. End post 110 includes an attachment surface 116 that extends from top portion 114 to bottom portion 112. Attachment surface 116 may be the exterior surface of end post 110, or may be a specially configured surface for providing a smooth transition from end post 110 to clamping member 150. Clamping member 150 is preferably attached to end post 110, such that clamping member 150 is in line with, or approximately in line with, fencing 120. This reduces the amount that clamping member 150 and fencing 120 stick out past end post 110, thereby reducing the chance that a user or animal will get snagged by clamping member 150 and/or fencing 120. Although end post 110 is depicted as the last post on the exemplary fence line, it will be appreciated that end post may be an intermediate line post along the fence line, or a corner post, as well.

Fencing 120 is preferably smooth metal strands that have been welded together or intertwined to form welded wire and net fencing; however, it will be appreciated that fencing 120 may also be nylon mesh fencing, barbed wire, chicken wire, construction fencing, erosion control fencing, or any type of elongated, continuously formed fencing material. Fencing 120 has a front portion 125, openings 126, and a rear portion 128. For purposes of explanation herein, front portion 125 represents the portion of fencing 120 that extends beyond end post 110 and clamping member 150, and rear portion 128 represents the portion of fencing 120 prior to end post 110 and clamping member 150. Openings 126 are preferably aligned vertically and laterally and are of equivalent size and shape. Alternatively, openings 126 vary in size, shape, alignment, and number found in different portions of the fence. For example, a small number of large openings 126 may be formed in a top portion of fencing 120, and a large number of small openings 126 may be formed in a bottom portion of fencing 120, whereas the large openings are larger at least in one dimension (e.g., width, height, diameter, etc.) as compared to the same dimension of the small openings.

As shown in FIG. 1, a vehicle 132 is preferably coupled to stretcher bar 130 via a cable or chain 160 having links 162, or other suitable tensioning device, to provide a stretching and tensioning force 164 (see FIG. 3) to fencing 120. Although vehicle 132 is depicted as an all-terrain-vehicle (ATV), other stretching means may be used. For example, a come-along, a truck, tractor, winch, or combinations thereof, may replace or be used together with vehicle 132.

Figure 2:
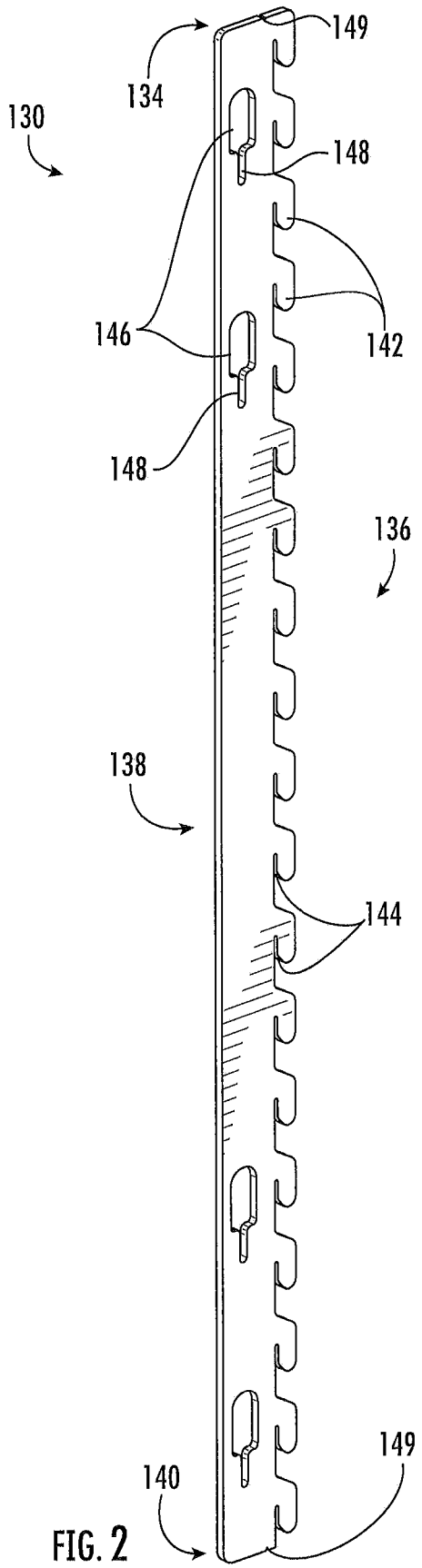
FIG. 2 is a perspective view of a stretcher bar of the system of FIG. 1 according to the present application.

Referring now also to FIG. 2 in the drawings, the preferred embodiment of stretcher bar 130 is illustrated. Stretcher bar 130 includes a top portion 134, a front portion 136, a rear portion 138, and a bottom portion 140. Rear portion 138 and front portion 136 extend between top portion 134 and bottom portion 140. Front portion 136 of stretcher bar 130 includes multiple (e.g., at least two) hooks 142. Hooks 142 are preferably spaced, shaped, and configured to matingly engage the openings 126 of fencing 120. Hooks 142 form recesses 144 that are configured to receive and retain openings 126. Hooks 142 are preferably formed together with the unitary structure of stretcher bar 130. Alternatively, hooks 142 may be separate from and detachable from front portion 136, thereby allowing hooks 142 to be adjustable to selectively conform to opening 126 in fencing 120. For example, hooks 142 may be adjustable vertically or in other orientations, to allow for specialized engagement with fencing 120. For example, in some applications, it may be desirable to use a hook 142 for each opening 126, or to use one hook 142 for every other opening 126. The latter configuration would provide ample stretching force, but would reduce the weight of stretcher bar 130.

Stretcher bar 130 preferably includes one or more notched openings 146. Each notched opening 146 includes at least one notch 148. Notched openings 146 and notches 148 are configured to receive and releasably retain the links 162 of chain 160. Preferably, notched openings 146 are vertically aligned along the length of stretcher bar 130. In addition, stretcher bar 130 may include a second set of notches 149 formed at or near top portion 134 and/or bottom portion 140, for aligning stretcher bar 130 vertically. For example, second set of notches 149 may be compared to a level or a string attached to a plumb-bob, indicating whether or not tensioning force 164 applied to stretcher bar 130 is roughly equally applied across stretcher bar 130.

Figure 3:
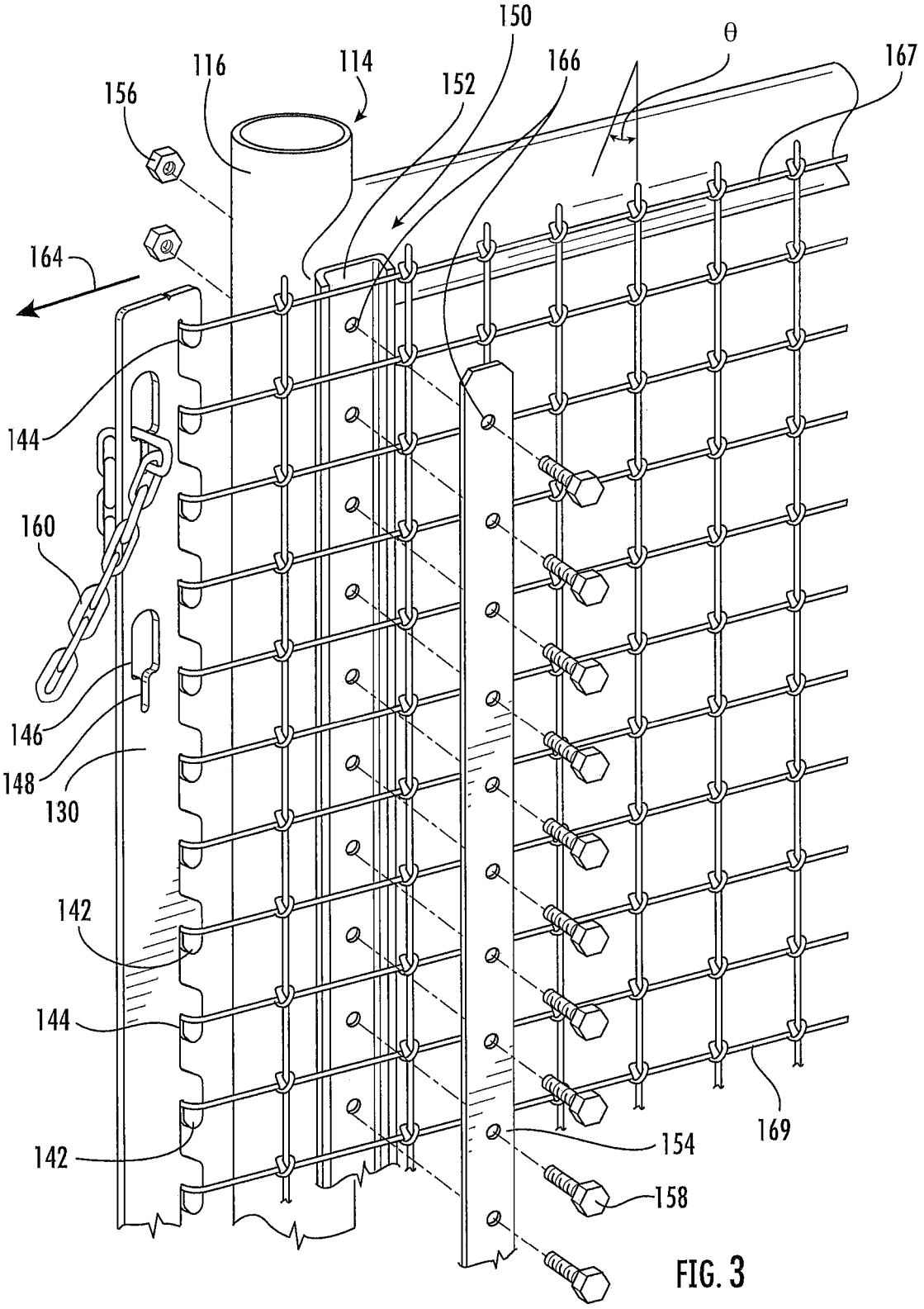
FIG. 3 is a partial assembly view of the system of FIG. 1 showing a clamping bar in an unassembled state according the present application.
Figure 4:
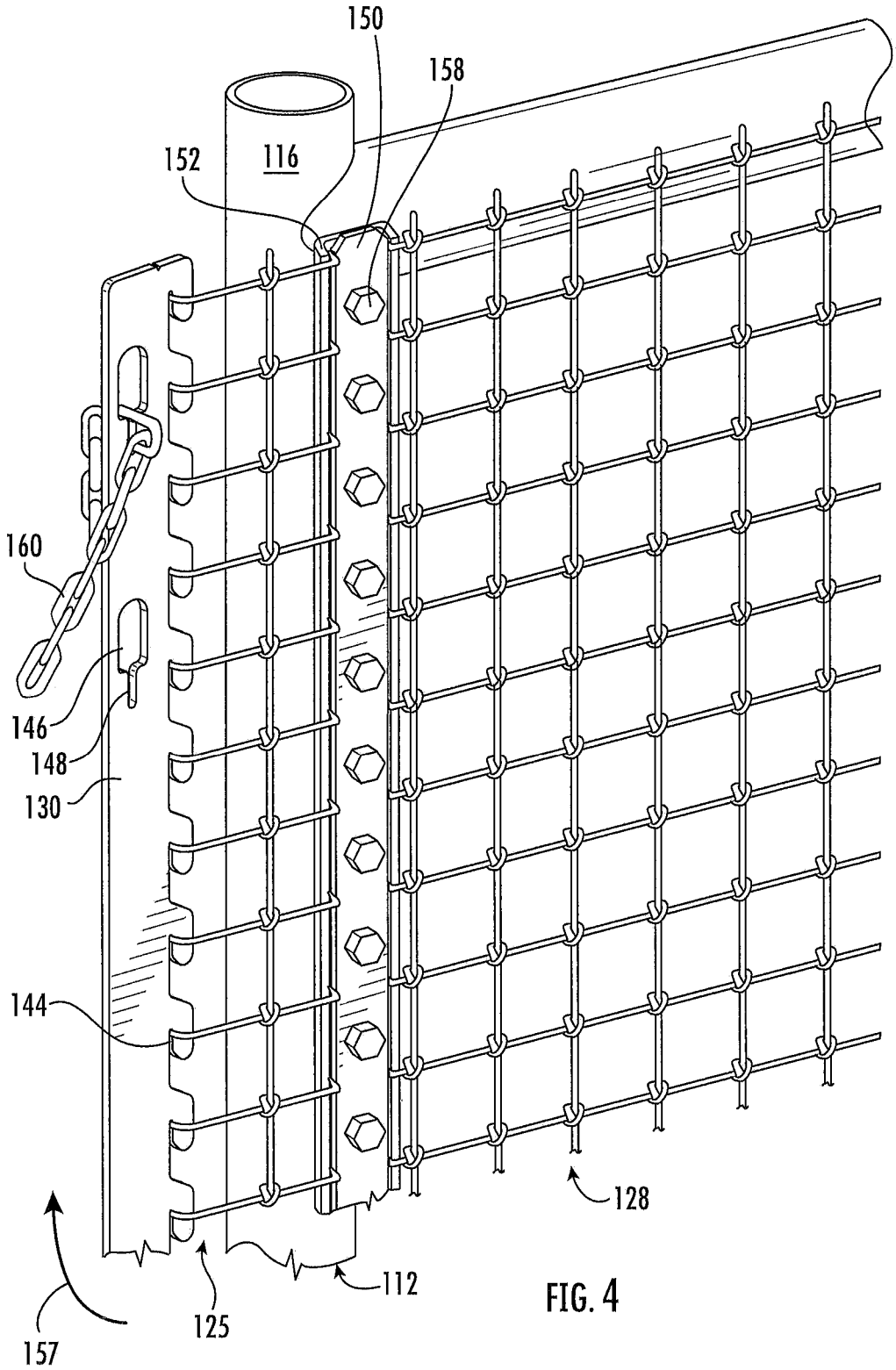
FIG. 4 is a partial assembly view of the system of FIG. 1 showing the clamping bar in an assembled state according the present application.

Referring now also to FIGS. 3 and 4 in the drawings, clamping member 150 is shown in an unassembled state in FIG. 3 and in an assembled state in FIG. 4. Clamping member 150 includes a channel member 152, a clamping bar 154, and one or more fasteners 158. Clamping member 150 is attached to end post 110 by attaching channel member 152 to end post 110, preferably in a permanent manner, such as by welding. In particular, stitch welding along the length of channel member 152 is preferred, as stitch welding reduces the chance that channel member 152 will warp during the welding process. It will be appreciated that channel member 152 may be attached to end post 110 by other suitable means, such as self-tapping screws, nuts, bolts, or other fasteners, either permanent or releasable. In addition, channel member 152 may be attached to end post 110, either prior to installation in the field, or may be attached in the field to an existing end post 110. Thus, the system of the present application may be either one of original manufacture, or may be a retrofit to an existing fence structure.

Clamping bar 154 is sized and configured to be received within the channel of channel member 152. Clamping bar 154 is preferably secured to channel member 152 with a plurality of nuts 156 and bolts 158, which pass through aligned apertures 166 in both channel member 152 and clamping bar 154. Alternatively, clamping bar 154 may be secured to channel member 152 using welds, self-tapping screws, clamps, and/or other suitable fasteners. By way of another example, clamping bar 154 may be secured to channel member 152, by using nuts 156 that are permanently attached to the back side of channel member 152. This configuration reduces the number of parts and components that have to be taken into the filed. Alternatively, U-bolts, circular ring clamps, and/or combinations of fasteners may be used to secure channel member 152 to end post 110.

As best seen in FIG. 4, it is preferred that sufficient clearance exist on each side of clamping bar 154, so that when clamping bar 154 is fastened to channel member 152 by nuts 156 and bolts 158, fencing 120 is wrapped about clamping bar 154 and securely sandwiched between clamping bar 154 and channel member 152.

Figure 5:
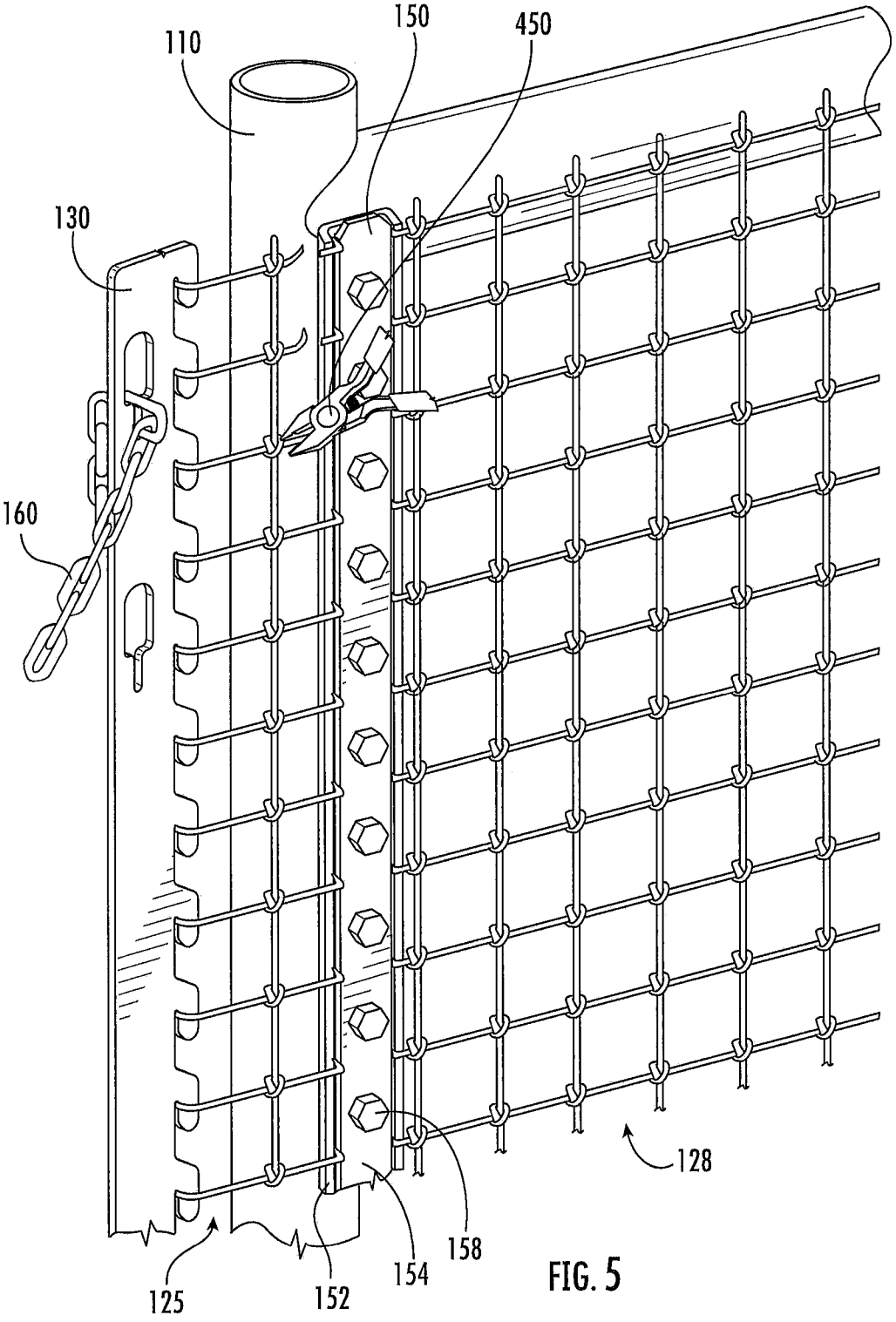
FIG. 5 is a partial assembly view of the system of FIG. 1 depicting a preferred embodiment of a method of stretching fencing according the present application.

Referring now also to FIG. 5 in the drawings, a method of erecting welded wire or net fencing according to a preferred embodiment of the present application is illustrated. First, an end post 110 is secured in the ground, such as with cement, gravel, pile driving, compacting, or combinations thereof at each end of the fence line. Channel member 152 has either been previously attached to end post 110 or has been attached to end post 110 in the field prior to stretching fencing 120. Then, fencing 120 is unrolled along the fence line from one end post 110 to the other end post 110. Fencing 120 is then attached to one end post 110 at the starting end of the fence line. This is preferably done by using the systems and methods described herein. Then, fencing 120 is temporarily attached to one or more intermediate line posts. Once fencing 120 has been attached to the starting end post 110 and various intermediate line posts, fencing 120 is ready to be properly stretched.

To stretch fencing 120, stretcher bar 130 is attached to fencing 120 by inserting hooks 142 into openings 126 and then moving stretcher bar 142 vertically until fencing 120 is engaged and retained within recesses 144. Then, stretcher bar 130 is coupled to vehicle 132 via chain 160. It will be appreciated that chain 160 should be coupled to vehicle 132, such that chain 160 is free to move, such as by rotation in the direction of arrow 157, so as to equalize tension force 164 being applied to stretched bar 130, thereby maintaining stretcher bar 130 in a generally vertical orientation. Utilizing multiple hooks 142, including up to one hook 142 for each opening 126 in fencing 120, ensures that the tension force 164 from stretcher bar 130 is distributed generally equally over the entire height of fencing 120. This reduces the chance that fencing 120 will be damaged during the stretching operation.

Although it is preferred that openings 126 of fencing 120 remain vertically aligned with clamping bar 152, it is not necessary that openings remain exactly aligned with clamping bar 152. For example, openings 126 may form a small offset angle θ with clamping bar 152. Such minor offset may be compensated for, once clamping bar 154 is bolted to channel member 152.

Next, fencing 120 is stretched past end post 110 and channel member 152. Then, clamping bar 154 is secured to channel member 152 using nuts 156 and bolts 158. This securely sandwiches fencing 120 between channel member 152 and clamping bar 154. Alternatively, clamping bar 154 may be secured to channel member 152 using welds, self-tapping screws, clamps, and/or other fasteners. By way of another example, after tensioning force 164 is applied, clamping bar 154 may be secured to channel member 152 by using bolts 158 that are received by nuts 156 that have been welded to the back side of channel member 152. At this step, any angle θ existing between openings 126 and end post 110 that occurred during the stretching process may be reduced and/or removed.

Once fencing 120 has been stretched and secured to end post 110 by clamping member 150, the tension in chain 160 may be removed and stretcher bar 130 may be removed from fencing 120. Then, any excess fencing 120 may be removed by a cutting device 450, such as wire cutters, grinders, saws, or other suitable wire cutting devices. It is preferred that fencing 120 be cut off as close to channel member 152 as possible to eliminate any wires from sticking out.

Although FIGS. 1-5 depict a single stretcher bar 130, the present application is not so limited. For example, multiple stretcher bars 130 may be used to obtain a better grip and/or a more distributed grip on fencing 120.

Figure 6:
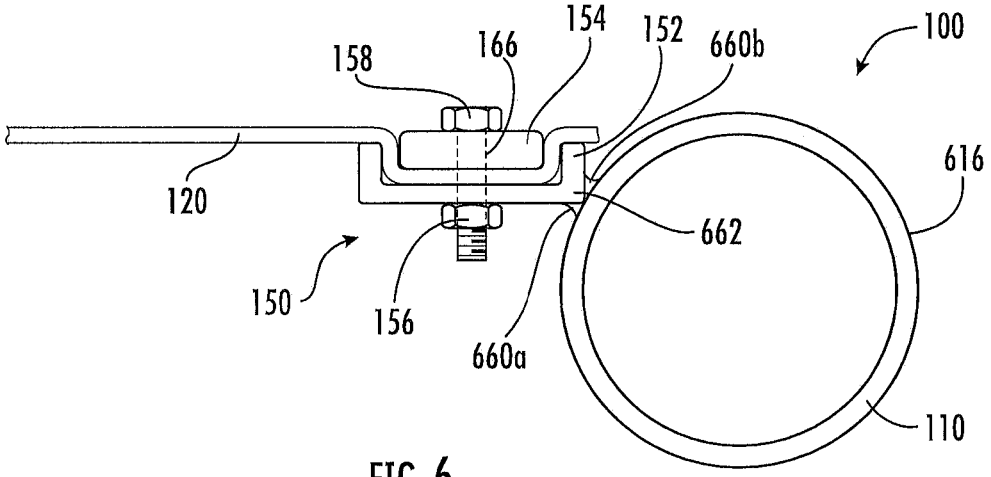
FIG. 6 is a top view of the system of FIG. 1 according to the present application.

Referring now also to FIG. 6 in the drawings, a top view of system 100 is illustrated. As is shown, clamping member 150, which includes channel member 152 and clamping bar 154 are secured to end post 110. Fencing 120 is sandwiched between clamping bar 154 and channel member 152 with nuts 156 and bolts 158 passing through apertures 176. Channel member 152 is secured to an attachment surface 616 of end post 110 using stitch welds **660*a*, 660*b* on each side of an edge or a single corner 662 of channel member 152. An attachment channel 676 is formed from concentrically aligned openings formed respectively at least in channel 652 and flat bar 654**.

Figure 7:
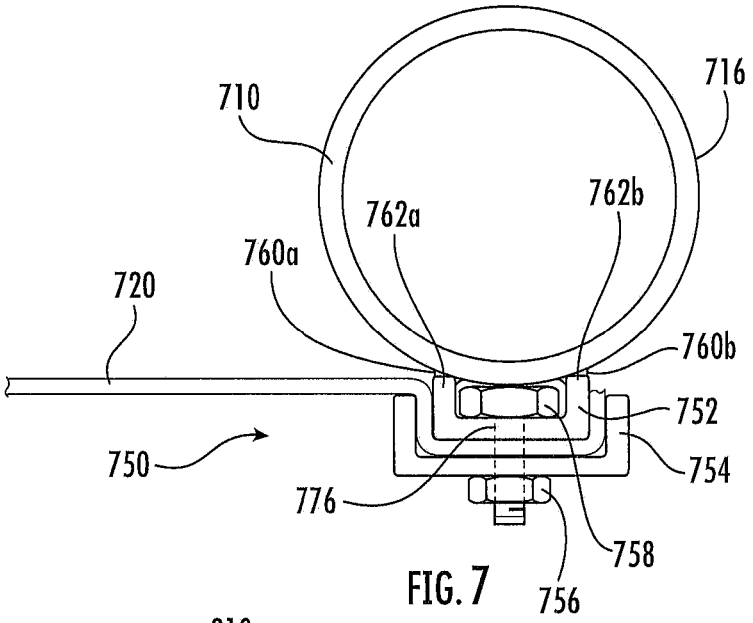
FIG. 7 is a top view of an alternative embodiment of a system of stretching fencing according to the present application.

Referring now also to FIG. 7 in the drawings, an alternative embodiment of the system of the present application is illustrated. In this embodiment, a clamping member 750 includes a channel member 752 and a channel-shaped clamping bar 754. A plurality of threaded studs (or bolts) 758 are secured within the channel of clamping bar 754 and protrude outward to receive nuts 756. Studs 758 may be either captured within the channel of clamping bar 754 to prevent turning, or may be permanently secured to channel bar 754, such as by welding or a press fit. Channel member 752 is secured to an attachment surface 716 of an end post 710 using stitch welds **760*a* and 760*b* formed along the length of channel member 752 at ends 762*a* and 762*b*. Aligned apertures 776 are formed in channel member 752 and channel-shaped clamping bar 754. As with other embodiments, fencing 720 is held secure by sandwiching fencing 720 between channel member 752 and clamping bar 754**.

Figure 8:
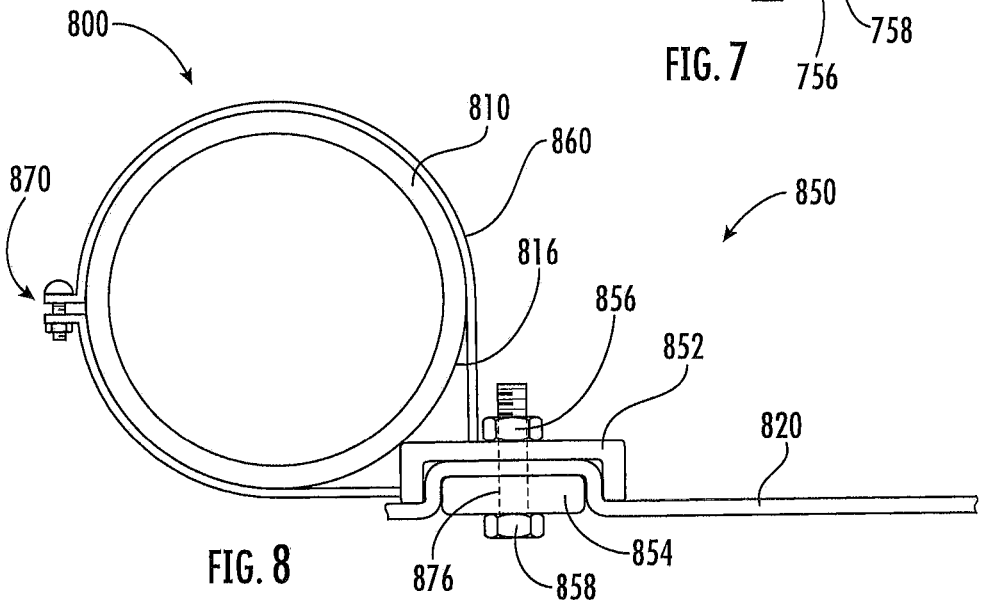
FIG. 8 is a top view of an alternative embodiment of a system of stretching fencing according to the present application.

Referring now also to FIG. 8 in the drawings, another alternative embodiment of a fence stretching system 800 according to the present application is illustrated. This is a "no-weld" embodiment, in which a clamping member 850 is attached to an end post 810 by a releasable attachment mechanism. Clamping member 850 includes a channel member 852, a clamping bar 854, and a releasable clamp 860. Releasable clamp 860 is attached to channel member 852, wraps around end post 810, and is tightened by fastener 870. Aligned apertures 876 are formed in channel member 852 and clamping bar 854. Fencing 820 is sandwiched between clamping bar 854 and channel member 852 with nuts 856 and bolts 858 passing through apertures 876. As with other embodiments, fencing 820 is held secure by sandwiching fencing 820 between channel member 852 and clamping bar 854.

Figure 9:
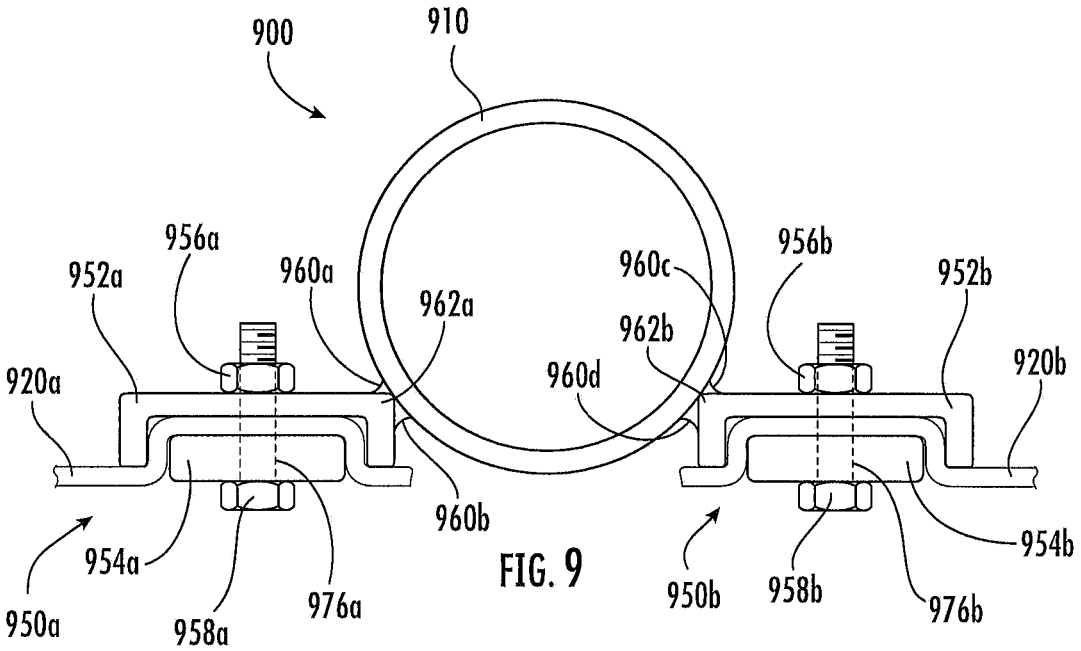
FIG. 9 is a top view of an alternative embodiment of a system of stretching fencing according to the present application.

Referring now also to FIG. 9 in the drawings, an alternative embodiment of a fence stretching system 900 according to the present application is illustrated. System 900 includes two separate clamping members **950*a* and 950*b*. Clamping members 950*a* and 950*b* include channel members 952*a* and 952*b* having clamping bars 954*a* and 954*b*, respectively. This embodiment is particularly useful for splicing two sections of fencing 920*a* and 920*b* together at a line post. Channel members 952*a* and 952*b* are secured at corners 962*a* and 962*b*, respectively, to an end post 910 preferably by using stitch welds 960*a* and 960*b*, and 960*c* and 960*d*, respectively. Fencing 920*a* is held secure by sandwiching fencing 920*a* between channel member 952*a* and clamping bar 954*a*. Likewise, Fencing 920*b* is held secure by sandwiching fencing 920*b* between channel member 952***b* and clamping bar 954*b*. Clamping bars 954*a* and 954*b* are held secure by bolts 958*a* and 958*b* passing through aligned apertures 976*a* and 976*b* and being fastened to nuts 956*a* and 956*b*, respectively.

Although only two clamping members 950*a* and 950*b* are shown, it will be appreciated that more clamping members may be utilized. For example three clamping members may be used to form a T-shaped connection of fencing. In addition, although clamping members 950*a* and 950*b* have been shown to "in-line" with each other, clamping members 950*a* and 950*b* (and any other clamping members) may be at different angles to each other. This is particularly useful when the sections of fencing being stretched and joined do not form right angles to each other.

Figure 10:
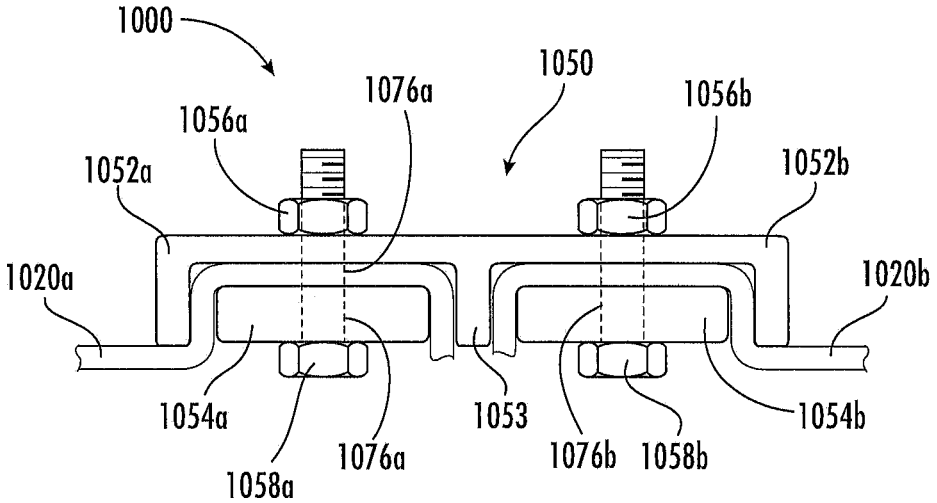
FIG. 10 is a top view of an alternative embodiment of a system of stretching fencing according to the present application.

Referring now also to FIG. 10 in the drawings, an alternative embodiment of a fence stretching system 1000 according to the present application is illustrated. System 1000 includes a dual channel clamping member 1050 having two integral clamping channel 1052*a* and 1052*b*. This embodiment is particularly useful for splicing two sections of fencing 1020*a* and 1020*b* together when no line post is present or available. Clamping channels 1052*a* and 1052*b* are configured to receive clamping bars 1054*a* and 1054*b*, respectively. Fencing 1020*a* is held secure by sandwiching fencing 1020*a* between channel member 1052*a* and clamping bar 1054*a*. Likewise, Fencing 1020*b* is held secure by sandwiching fencing 1020*b* between channel member 1052*b* and clamping bar 1054*b*. Clamping bars 1054*a* and 1054*b* are held secure by bolts 1058*a* and 1058*b* passing through aligned apertures 1076*a* and 1076*b* and being fastened to nuts 1056*a* and 1056*b*, respectively.

Clamping member 1050 may be used without having to weld, or otherwise attach clamping member 1050 to an end post or line post.

Figure 11:
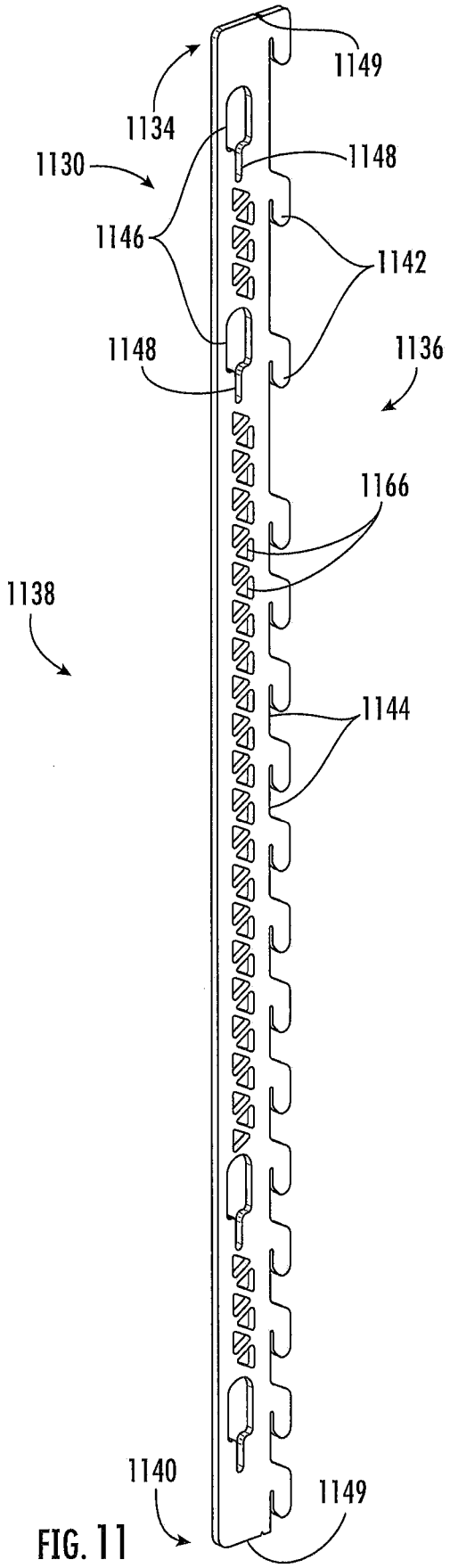
FIG. 11 is a perspective view of an alternative embodiment of a stretcher bar according to the present application.

Referring now also to FIG. 11 in the drawings, an alternative embodiment of a stretcher bar 1130 is illustrated. Stretcher bar 1130 includes a top portion 1134, a front portion 1136, a rear portion 1138, and a bottom portion 1140. Rear portion 1138 and front portion 1136 extend between top portion 1134 and bottom portion 1140. Front portion 1136 of stretcher bar 1130 includes multiple (e.g., at least two) hooks 1142. Hooks 1142 are preferably spaced, shaped, and configured to matingly engage the openings 126 of fencing 120 (see FIG. 1). Hooks 1142 form recesses 1144 that are configured to receive and retain openings 126. Hooks 1142 are preferably formed together with the unitary structure of stretcher bar 1130. Alternatively, hooks 1142 may be separate from and detachable from front portion 1136, thereby allowing hooks 1142 to be adjustable to selectively conform to opening 126 in fencing 120. For example, hooks 1142 may be adjustable vertically or in other orientations, to allow for specialized engagement with fencing 120. For example, in some applications, it may be desirable to use a hook 1142 for each opening 126, or to use one hook 1142 for every other opening 126. The latter configuration would provide ample stretching force, but would reduce the weight of stretcher bar 1130.

Stretcher bar 1130 preferably includes one or more notched openings 1146. Each notched opening 1146 includes at least one notch 1148. Notched openings 1146 and notches 1148 are configured to receive and releasably retain the links 162 of chain 160 (see FIG. 1). Preferably, notched openings 1146 are vertically aligned along the length of stretcher bar 1130. In addition, stretcher bar 1130 may include a second set of notches 1149 formed at or near top portion 1134 and/or bottom portion 1140, for aligning stretcher bar 1130 vertically. For example, second set of notches 1149 may be compared to a level or a string attached to a plumb-bob, indicating whether or not tensioning force 164 (see FIG. 1) applied to stretcher bar 1130 is equally applied across stretcher bar 1130.

Stretcher bar 1130 includes at least one additional aperture 1166 disposed along stretcher bar 1130 to reduce weight. Although apertures 1166 have been shown as being generally triangular in shape, it will be appreciated that apertures 1166 may have any shape and/or configuration. It is preferred that apertures 1166 reduce the weight of stretcher bar 1130 without adversely affecting the strength of stretcher bar 1130.

It is apparent that an invention with significant advantages has been described and illustrated. Although the present application is shown in a limited number of forms, it is not limited to just these forms, but is amenable to various changes and modifications without departing from the spirit thereof.

What is claimed is:

1. A clamping member, comprising:

a clamping channel;

a clamping bar configured to be received within the clamping channel; and at least one fastener for securing the clamping bar to the clamping channel;

wherein the clamping bar and the clamping channel are correspondingly shaped, sized, and configured, such that fencing is held secure between the clamping bar and the clamping channel when the clamping bar is secured to the clamping channel;

wherein the clamping channel has a c-shaped cross section with three surfaces forming a channel and the clamping bar is sized and shaped to have three sides configured to fit within the clamping channel, so as to sandwich the fencing between all three surfaces of the c-shaped cross section of the clamping channel and all the three sides of the clamping bar when the clamping bar is secured to the clamping channel; and wherein the clamping channel is coupled to a post in an offset position, such that the at least one fastener does not extend into or through the post.

2. The clamping member of claim 1, wherein the end post is permanently coupled to the clamping member.

3. The clamping member of claim 1, wherein the channel of the clamping channel opens toward the post.

4. The clamping member of claim 1, wherein the clamping member further comprises:

a releasable clamping mechanism for releasably coupling the clamping member to the post.

5. The system of clamping member of claim 1, wherein the at least one fastener comprises:

a bolt; and a nut;

wherein the bolt and the nut are both detachable from the clamping member.

6. The clamping member of claim 1, wherein the at least one fastener comprises:

a bolt; and a nut;

wherein one of the bolt or the nut is permanently coupled to the clamping member.

7. The clamping member of claim 1, wherein the at least one fastener comprises:

a bolt; and a nut;

wherein either the bolt or the nut is captured within a channel of the clamping channel.

8. The clamping member of claim 1, further comprising:

at least two clamping members;

wherein the at least two clamping members are rigidly coupled together and the clamping bar and the clamping channel of each clamping member are correspondingly shaped, sized, and configured, such that at least a portion of the fencing is held secure between the clamping bar and the clamping channel when the clamping bar is secured to the clamping channel.

9. The clamping member of claim 8, wherein the at least two clamping members are coupled together at a post.

10. The clamping member of claim 8, wherein the at least two clamping members are coupled together adjacent said clamping channels.

11. A stretcher bar comprising:

a front portion;

a rear portion;

a top portion;

a bottom portion;

a plurality of hook members for engaging the fencing; and at least one notched opening configured to receive at least one tensioning device;

wherein the front portion, the rear portion, the top portion, the bottom portion, and the hook members form a generally planar member; and wherein the at least one notched opening passes through the generally planar member.

12. The stretcher bar of claim 11, wherein the hook members form recesses that are configured to receive and retain openings in a fence.

13. The stretcher bar of claim 11, wherein the hook members are spaced equally along a length of the stretcher bar.

14. The stretcher bar of claim 11, wherein the hook members are spaced at varying distances along a length of the stretcher bar.

15. The stretcher bar of claim 11, wherein at least one of the hook members is adjustable.

16. The stretcher bar of claim 11, wherein the stretcher bar further comprises:

one or more additional apertures disposed along a length of the stretcher bar to reduce the weight of the stretcher bar.

17. The stretcher bar of claim 11, further comprising:

at least one notched opening disposed near the top of the planar member and at least one notched opening disposed near the bottom of the planar member, such that at least one tensioning device pulls from the top of the planar member and at least one tensioning device pulls from the bottom of the planar member.

18. The stretcher bar of claim 17, wherein the at least one tensioning device is connected to a come-along.

19. The stretcher bar of claim 17, wherein the at least one tensioning device is connected to a vehicle.

20. A clamping member, comprising:

a channel member;

a clamping bar sizably configured to mate with the channel member; and at least one fastener configured for securing the clamping bar to the channel member;

wherein the clamping bar and channel member are correspondingly shaped, sized, and configured, such that fencing is held secure between the clamping bar and the channel member when the clamping bar is secured to the channel member;

wherein the channel member and the clamping bar each have a c-shaped cross section with three surfaces forming a channel, the clamping bar being sized and shaped to fit around the three surfaces of the channel member, so as to sandwich the fencing between the channel member and the clamping bar when the clamping bar is secured to the channel member;

wherein the channel member is coupled to a post with the channel of the channel member opening toward the post, such that a head of the at least one fastener is contained substantially within the channel; and wherein the at least one fastener does not extend into or through the post.

* * * * *